US008665166B2

(12) United States Patent
Ahn et al.

(10) Patent No.: US 8,665,166 B2
(45) Date of Patent: Mar. 4, 2014

(54) COMPACT MULTIBEAM REFLECTOR ANTENNA

(75) Inventors: Jiho Ahn, Seoul (KR); Alexander Venetskiy, Seoul (KR); Elena Frolova, Seoul (KR)

(73) Assignee: Telefrontier Co., Ltd. (KR)

( * ) Notice: Subject to any disclaimer, the term of this patent is extended or adjusted under 35 U.S.C. 154(b) by 364 days.

(21) Appl. No.: 13/129,449

(22) PCT Filed: Nov. 11, 2009

(86) PCT No.: PCT/KR2009/006600

§ 371 (c)(1),
(2), (4) Date: May 16, 2011

(87) PCT Pub. No.: WO2010/056029

PCT Pub. Date: May 20, 2010

(65) Prior Publication Data

US 2012/0013516 A1 Jan. 19, 2012

(30) Foreign Application Priority Data

Nov. 17, 2008 (RU) ..... 2008145112
Sep. 23, 2009 (KR) ..... 10-2009-0089956

(51) Int. Cl.
*H01Q 13/00* (2006.01)

(52) U.S. Cl.
USPC ..... 343/781 CA

(58) Field of Classification Search
USPC ..... 343/779, 781 CA, 781 P, 781 R
See application file for complete search history.

(56) References Cited

U.S. PATENT DOCUMENTS

| | | | | |
|---|---|---|---|---|
| 6,831,613 | B1 * | 12/2004 | Gothard et al. | 343/779 |
| 7,081,863 | B2 * | 7/2006 | Inasawa et al. | 343/781 CA |
| 7,187,340 | B2 * | 3/2007 | Kralovec et al. | 343/781 CA |
| 7,405,708 | B2 * | 7/2008 | Ahn et al. | 343/781 CA |

* cited by examiner

*Primary Examiner* — Seung Lee
(74) *Attorney, Agent, or Firm* — John K. Park; Park Law Firm

(57) ABSTRACT

The inventive device enables to ensure its compactness, that is, a minimum thickness at a high antenna efficiency of an antenna in the frequency range 10.7-12.75 GHz. This technical effect can be achieved because the antenna comprises a main reflector (1), at least two feeds (2) and at least two sub-reflectors (3). Each sub-reflector is provided with such a shape of its external surface that ensures reflection of the feed directional pattern central beam to the edge of the main reflector and reflection of a lateral beam to the central area of the main reflector, the sub-reflector adjoining surfaces being truncated.

16 Claims, 10 Drawing Sheets

COMPACT MULTIBEAM REFLECTOR ANTENNA

TECHNICAL FIELD

This invention relates to antenna and feeder devices and may be used as a satellite television antenna.

BACKGROUND ART

Parabolic reflector antennas are widely used as satellite television antennas owing to a number of factors, including:

low cost;

wide band of operating frequencies;

simple work with waves of different polarizations;

relatively high aperture efficiency (AE) (usually 60-65 percent).

A parabolic antenna comprises a main reflector of which the surface is the result of parabolic movement along a trajectory in 3D space. The most common type of such reflector is the result of parabolic generatrix rotation around the axis passing through the parabola apex and focus. The parabolic antenna feed is located in the parabola focus. Thus a directional pattern with one main maximum (beam) is formed in the direction of the parabola axis. The shortcomings of parabolic antennas of this type are the characteristics of its single-beam and big size.

The big size of antennas creates the following shortcomings:

When those antennas are installed outdoor, they distort the architectural image of buildings. In particular, some countries of the European Union adopted legislation limiting installation of parabolic antennas on building walls and roofs.

Parabolic antennas can be hardly, if not at all, used on mobile carriers, especially when signal reception should be ensured in moving cars, trains, ships, etc.

When fixed near balconies or windows, antennas lead to excessive light blockage.

Under those circumstances, there is a need to develop plane and compact multibeam antennas for receiving a satellite television signal, having significantly smaller dimensions and ensuring simultaneous reception of signals from several satellites.

Dual-reflector antennas are more compact than parabolic reflector antennas. Unlike single-reflector parabolic antennas, which comprise one main reflector transforming a near-spherical feed wave front propagating from the feed to a plane wave front propagating from a big reflector, dual-reflector antennas comprise two reflectors—a big (main) reflector and a small (auxiliary or sub-reflector) reflector. Dual-reflector antennas solve the same task—they transform a near-spherical wave front of the feed into a plane wave front of the main reflector. However, the availability of an additional degree of freedom, namely a sub-reflector, makes this wave transformation more adaptable and enables the resolution of more complex problems in the field of achieving better electrical and dimensional characteristics of an antenna. There are different types of dual-reflector antennas, e.g., Cassegrain types of antennas, Gregory types of antennas, etc. They differ by their ray tracing distribution going from the feed to the sub-reflector and then to the main reflector. In Cassegrain type antennas beams going from the central part of the feed wave front come to the central part of the main reflector, and beams going from a lateral part of the feed wave front come to a lateral part of the main reflector.

An ADE (axially displaced ellipse) antenna is known (GB Patent #973583, publ. 1964). This antenna comprises a main reflector, a sub-reflector and a feed. The main reflector and the sub-reflector are made as bodies of revolution with a common revolution axis. The revolution axis is the axis 0z. The generatrix of the main reflector is a parabola. It is important that the parabola focus is not on the axis of revolution. The generatrix of the sub-reflector may have an arbitrary shape. In one case, a sub-reflector with an elliptic generatrix may be provided as in GB Patent #973583. This technical solution uses the following arrangement of the ellipse and parabola focuses: one ellipse focus coincides with the parabola focus, and the other ellipse focus is located at the axis of revolution.

Apart from antenna systems using a parabola and an ellipse as generatrices (as, for example, in the foregoing ADE system), there also exist other antenna systems with beam path inversion (inversed ray tracing). The feed field for reflector antennas may be represented as a totality of beams radiating from a point (feed phase center) in a limited space sector. In systems with inversed ray tracing, the feed field propagating from the central part of the radiation sector is reflected by a sub-reflector to a peripheral part of the main reflector, and the feed field propagating from a peripheral part of the radiation sector is reflected by a sub-reflector to the central part of the main reflector. Herewith, the main property of reflector antennas is maintained: the feed field is transformed into a locally plane wave propagating from the main reflector aperture. The constructive synthesis methods for generatrices of a system with beam path inversion are well known in the art. Such synthesis may be fulfilled by setting a feed directional pattern, space coordinates of the feed phase center and starting points of the reflector surfaces (e.g., for the central beam). Further, by moving along the angle coordinate from the central direction, one may obtain a surface shape for a system with beam path inversion from the condition of beam paths length equality. Generatrix pairs in such systems may be used instead of the "parabola-ellipse" pair for systems similar to ADE systems.

An antenna is known, which comprises a main reflector with a parabolic generatrix and a sub-reflector with an elliptic generatrix, forming a circle and a peak facing the main reflector and located between the circle and the main reflector (RF Patent #2296397, publ. 2006). The feed is located at the longitudinal axis of symmetry in the main reflector base between the main reflector parabolic surface and sub-reflector. This is a traditional ADE antenna optimized for obtaining maximum gain factor at minimum antenna thickness. Minimum antenna thickness (ratios H/D of 0.2-0.25 were obtained, where H is antenna thickness, D is main reflector diameter) is provided by special ratios between reflector parameters of the main reflector determined in the said RF Patent.

One limitation of the above single reflector and dual-reflector antennas with one feed, which are designed for satellite television systems, is their single main beam characteristic. An antenna has one input made as, e.g., a waveguide of a circular or other shape, and it has a directional pattern with a narrow main lobe oriented along the antenna axis of revolution. Such an antenna receives (transmits) signals mainly in a sector of angles corresponding to the main lobe of directional pattern. At the same time, many applications require multiple simultaneous reception or transmission of signals from multiple directions without turning the antenna or changing its configuration. This situation occurs, e.g., in receiving a satellite television signal. This situation is typical when several satellites work simultaneously at different azimuth angles (elevation bearings for all satellites at geostationary orbits are equal). Therefore, an antenna capable of receiving signals from several satellites without changes in configuration or mechanical rotation expands the capabilities of a satellite television reception system and, in particular, increases a number or information capacity for a number of channels receivable per one antenna.

Multibeam parabolic antennas have additional capabilities in comparison with single-beam parabolic antennas. Multibeam antennas use several feeds which are, as a rule, located near the focus. In this case, several directional patterns (beams) are formed in different directions, wherein each of them relates to its feed. As advantages, such antennas have multibeam characteristics, i.e., the capability to transmit and receive signals from various directions from/to one main reflector simultaneously as well as forming a complex-shape directional pattern consisting of a plurality of main lobes. The latter property, in particular, is widely used in satellite-based transmitting antennas.

A multibeam antenna is known (RF Patent #2173496, publ. 2001), which, in particular, was used in satellite television systems. This antenna is built according to a dual-reflector layout. In this antenna, the generatrix of the main reflector is a parabola, the generatrix of the sub-reflector is an ellipse, and the reflector surfaces are formed as a result of the generatrices spatial revolutions around axes orthogonal to the direction of the main lobe. Radiation sources are located at a spatial focal curve.

A disadvantage of this antenna is its large dimensions. It is connected with the fact that it has a rather high efficiency only in cases where its reflectors are long-focus. The long-focus characteristic of an optical system is usually determined by a ratio between the focal length of a parabolic main reflector F to its diameter D or to another typical dimension.

For the purpose of improving the antenna characteristics, such as directivity gain (DG), level of side lobes, etc., an antenna system may be shaped according to the offset layout, and systems "feed—sub-reflector", as in the Cassegrain dual-reflector system, may be used as feeds of the main reflector. The closest technical solution to the inventive antenna is an offset system for satellite signals transmitting (JP4068803), wherein the main reflector representing a cut from a paraboloid of revolution is radiated with a plurality of horns with a corresponding formation of a plurality of partial directional patterns (DP) in a variety of directions. For the purpose of improving the properties of partial directional patterns, each horn is provided with one or two additional sub-reflectors.

The disadvantages of this antenna include its large dimensions due to a great ratio between its focal length and diameter F/D, a small angular distance between main lobes of partial directional patterns (DPs), a relatively low aperture efficiency (AE), and mutual blockage of "feed—sub-reflector" systems.

DISCLOSURE OF INVENTION

The objective of this invention is to provide a compact (i.e., with a minimum ratio between the antenna thickness H and its diameter D) multibeam reflector antenna having a minimum thickness.

The technical effect that may be achieved when using the inventive antenna consists in giving the antenna properties of compactness together with maintaining high antenna aperture efficiency in the frequency range from 10.7 to 12.75 GHz.

In order to achieve the stated objective and the above technical effect, the inventive antenna differs from a known antenna comprising a main reflector and at least two feeds and at least two sub-reflectors, each of the latter being intended for re-reflecting a wave from its corresponding feed to said main reflector and converting a feed wave front to a plane front of a wave reflected from said main reflector, characterized in that each sub-reflector is provided with such a form of its external surface which ensures reflection of a feed directional pattern central beam to the edge of said main reflector and reflection of a lateral beam to a central area of said main reflector, the adjoining surfaces of said sub-reflectors being truncated.

Additional embodiments of the inventive device are also possible, wherein it is appropriate that:

a common cover is introduced, which may be installed on the edge of the main reflector, and the sub-reflectors are fixed to the cover;

the feeds are made as horns;

the adjoining walls of the horns are mated (in contact);

the longitudinal axes of the feeds and their corresponding sub-reflectors are tilted in relation to the longitudinal axis of the main reflector;

the longitudinal axes of the feeds are tilted to the longitudinal axis of the main reflector at an greater angle than an angle between the longitudinal axes of their corresponding sub-reflectors and the longitudinal axis of the main reflector;

the adjoining surfaces of the sub-reflectors are truncated by bisecting planes, mainly planes tilted to the longitudinal axis of the main reflector at an angle measuring half of a tilting angle of the corresponding sub-reflector to the longitudinal axis of the main reflector;

the adjoining surfaces of the sub-reflectors are mated (in contact) and made as a single element;

the adjoining surfaces of the sub-reflectors have a gap;

the main reflector is made as a body of revolution;

the shape of the main reflector generatrix is made parabolic;

each sub-reflector is made as a body of revolution;

the generatrix shape of a sub-reflector is elliptical;

the generatrix shape of a sub-reflector is hyperbolic;

the ratio $I=d/D$ between the sub-reflector maximum diameter d to the main reflector opening diameter D is made within the limits $0.1<I<0.2$. (FIG. 1)

Thus, the claimed technical solution provides for a multibeam system for satellite signals transmission wherein each sub-reflector is made with a shape of external surface that may ensure reflecting the central beam of the feed wave front (directional pattern) to a lateral part of the main reflector and the lateral beam of the feed wave front to the central part of the main reflector. For preset values of gain factor and positions of main lobes, the geometry of the main reflector, the geometry of the sub-reflector and its position relative to the main reflector are selected to reach maximum antenna aperture efficiency for beams tilted from the central position.

BRIEF DESCRIPTION OF DRAWINGS

The above mentioned advantages as well as the specific features of this invention are further explained by its preferred embodiment with reference to the appended drawings, where.

BEST MODE FOR CARRYING OUT THE INVENTION

Figure 1:
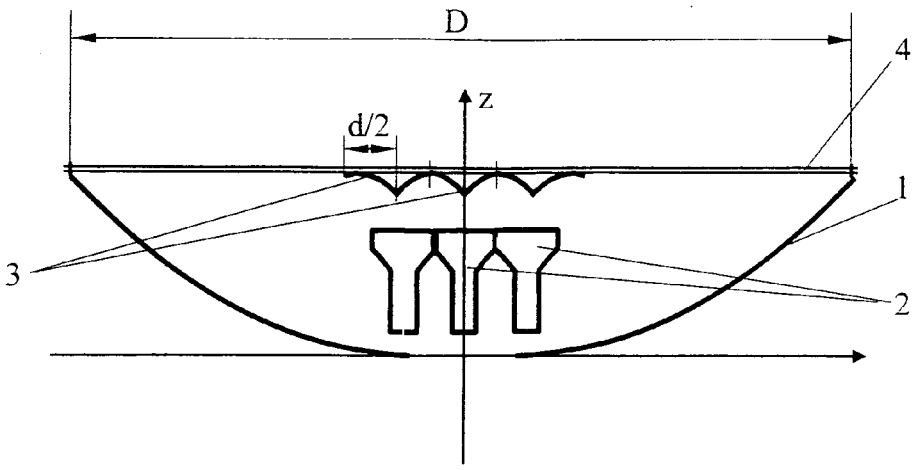
FIG. 1 schematically shows the inventive antenna.
Figure 2:
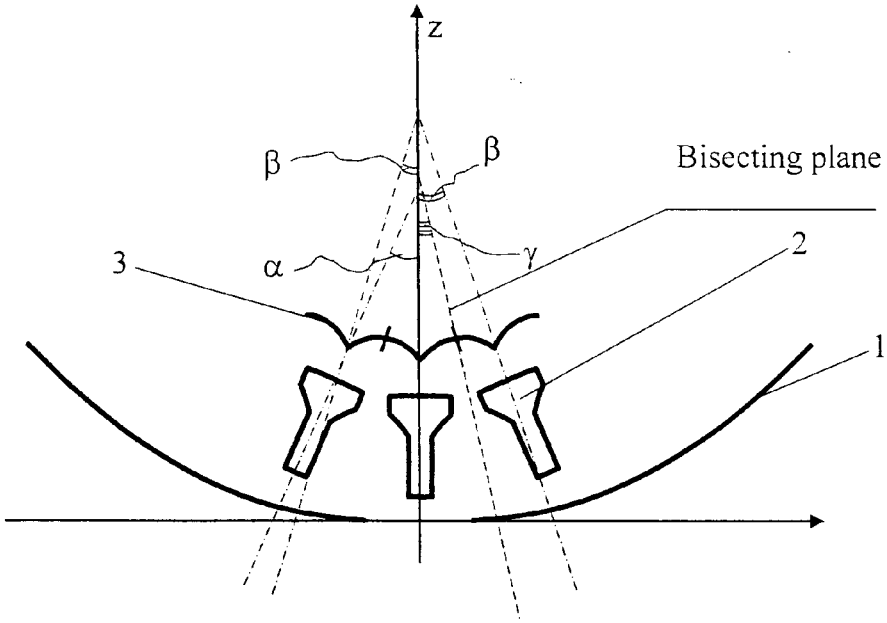
FIG. 2—same as in FIG. 1, another embodiment.
Figure 3:
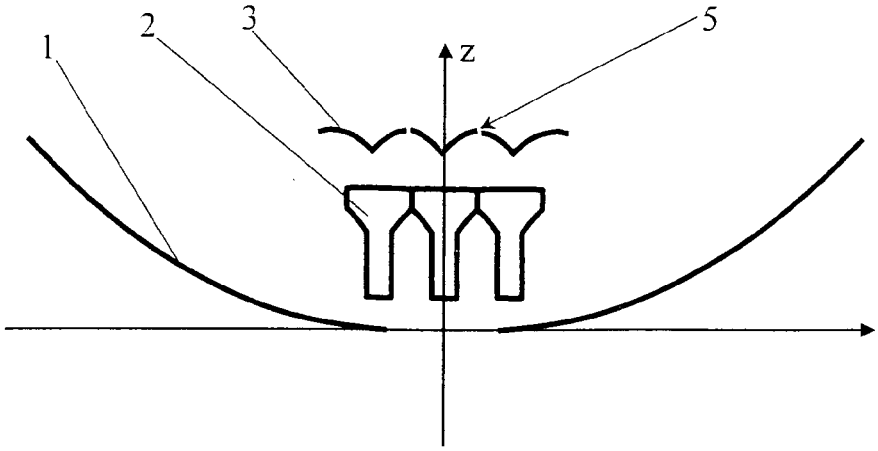
FIG. 3—same as FIG. 1, the third embodiment.

The antenna shown in FIG. 1-3 comprises a main reflector 1, at least two feeds 2 and at least two sub-reflectors 3. Each of the sub-reflectors 3 is designed for re-reflecting a wave from its corresponding feed 2 to the main reflector 1 and converting a wave front from a feed 2 into a plane front (FIG. 4) of a wave reflected from the main reflector 1. The main reflector 1 is made as a body of revolution, mainly with a parabolic generatrix.

Each sub-reflector 3 is made with an external surface form which ensures reflection of the directional pattern central beam from a feed 2 to lateral parts of the main reflector 1 and reflection of a lateral beam to the central area of the main reflector 1. The adjoining surfaces of the sub-reflectors 3 are truncated.

A common cover 4 may be added to the device by installing it on the plane of the edge of the main reflector 1 and fixing the sub-reflectors 3 on the cover 4 (FIG. 1).

The feeds 2 may be made, in particular, as horns (FIG. 1-3).

The adjoining walls of the horns may be mated (FIG. 3), but in such a case it may be required to reduce horn wall thicknesses in the direction of the mated (contacting) walls.

The longitudinal axes of the feeds 2 and their corresponding sub-reflectors 3 may be tilted to the longitudinal axis of the main reflector 1 (FIG. 2).

The longitudinal axes of the feeds 2 are tilted to the longitudinal axis of the main reflector 1 at a greater angle $\alpha$ than the longitudinal axes of their corresponding sub-reflectors 3, which are tilted at an angle $\beta$ (FIG. 2).

It is appropriate that the adjoining surfaces of the sub-reflectors 3 were truncated by bisecting planes, i.e., planes that are tilted to the longitudinal axis of the main reflector 1 at an angle $\gamma$ which is half of the tilting angle $\beta$ of the sub-reflectors 3 (FIG. 2).

The adjoining surfaces of the sub-reflectors 3 may be mated (FIG. 1, 2).

The adjoining surfaces of the sub-reflectors 3 may have a gap 5 between them (FIG. 3).

The main reflector 1 and the sub-reflectors 3 may be made as bodies of revolution (FIG. 1-3).

The shape of the generatrix for the main reflector 1 may be parabolic.

The shape of the generatrix for the sub-reflector 3 may be elliptic or hyperbolic.

The ratio $I=d/D$ between the maximum diameter d of the sub-reflector 3 and the diameter D of the opening of the main reflector 1 is selected within the range $0.1<I<0.2$ (FIG. 1).

For the convenience of technical explanation, only the invention of at least two feeds and at least two corresponding sub-reflectors were described above as an example.

However, it is understood that the invention regarding one feed and at least two sub-reflectors can be included in the present invention. For example, for the case of receiving (transmitting) multiple signals which come from the closest satellites, by placing each peak of the sub-reflectors much closer, Each of the sub-reflectors can be designed for re-reflecting a wave from its one common feed to the main reflector and converting a wave front from the common feed into a plane front of a wave reflected from the main reflector.

The compact multibeam reflector antenna (FIG. 1-3) works as follows.

Figure 4:
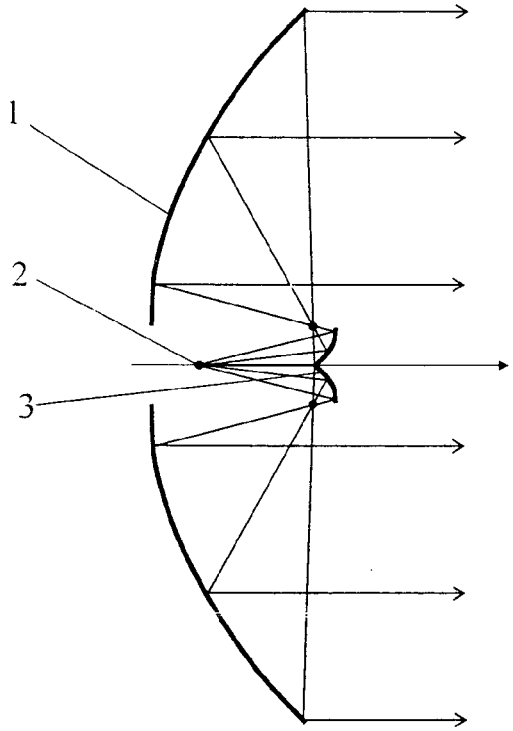
FIG. 4 shows beam paths in an ADE system using one feed and one sub-reflector.

One specific feature of the inventive antenna is that each sub-reflector 3 is made so as to have an external surface shape which would ensure reflection of the directional pattern central beam for the feed 2 to the lateral area of the main reflector and reflection of a lateral beam to the central area of the main reflector 1 (FIG. 4). This specific feature is also used in an ADE system (GB Patent #973583, publ. 1964), (RF Patent #2296397, publ. 2006), but only when one feed and one sub-reflector 3 are used.

This antenna structure is optimal for constructing a multibeam antenna system and its reasons are as follows:

1. The feeds 2 are in the center of the antenna (FIG. 1-3) and create blockage of the aperture in the main reflector 1. A main part of the power in the ADE system, which is radiated by the feed 2, goes to the edge of the main reflector 1, thus reducing the blockage effect.

2. The distributed focus in systems with axial symmetry becomes the circular focus. It improves scanning properties of a multibeam antenna system, since the directional pattern main lobe, while deviating from the central position, loses gain less quickly than Cassegrain type antennas with the concentrated focus, when a pair of "feed-sub-reflector" shifts in the direction orthogonal to the Z-axis.

3. The circular focus increases the diameter of the antenna main reflector 1, thus improving its compactness (namely coefficient H/D) along the Z-axis.

When studying the properties of the inventive compact antenna in the process of working at this invention, scanning properties of such antenna were found (seemingly, for the first time). It was shown that when a pair of "feed 2-sub-reflector 3" shifts in the direction orthogonal to the ADE antenna axis of symmetry, the direction of the directional pattern maximum tilts from its original position. In spite of the fact that at such shift the position of the circular focus for the sub-reflector 3 moves significantly in relation to the circular focus of the parabola of the main reflector 1, up to certain shift values, no significant loss in aperture efficiency (AE) occurs. Multi beam characteristics of an antenna system may be achieved by arranging two or more pairs of "feed 2-sub-reflector 3" in front of the main reflector 1 and each of such pairs together with the main reflector 1 provides its partial directional pattern in the preset direction.

Let the point Q $(\theta;0)$ be the location of the feed 2 for the initial wave (FIG. 5) irradiating the sub-reflector 3; A $(\theta;r(\theta))$ be the initial wave beam reflection point on the sub-reflector 3; B be the beam reflection point on the main reflector 1. The beam front from the source Q $(\theta;0)$ is converted by the dual-reflector system into the plane wave beam front with the preset reflection law $x(\theta)$ (i.e., the law of correspondence between beams of the initial and the final waves).

Figure 5:
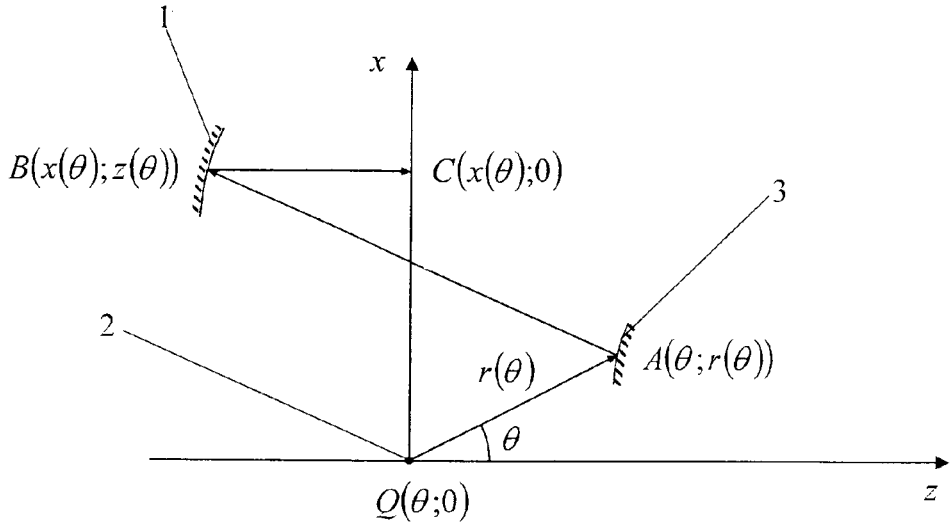
FIG. 5 shows a chart of a dual-reflector antenna system with a preset amplitude distribution for a plane and axial symmetry problem.

We will try to find the coordinates of the beam reflection point B in the main reflector 1 in the parametric form $x=x(\theta)$ and z=z(θ), where x, Band z are shown in FIG. 5. The optical path length S=QA+AB+BC, where QA, AB and BC are distances between the corresponding points.

A solution for the sub-reflector 3, which comprises a single integral from x(θ), may be described by the equation:

$$r(\theta) = S[(1-\cos\theta) + c(S, r_0, \theta_0)V(\theta, \theta_0)]^{-1}, \quad (1)$$

where $$r_0 = r(\theta_0),$$

$$V(\theta, \tau) = \exp\int_{\tau}^{\theta} a(t)dt,$$

$$a(\theta) = \frac{x(\theta)\sin\theta + S(1-\cos\theta)}{x(\theta)(1-\cos\theta) - S\sin\theta},$$

$$c(S, r_0, \theta_0) = \frac{S}{r_0} - (1-\cos\theta_0).$$

In the formula (1) r(θ) is the radius-vector of the surface of the sub-reflector 3, $r_0$ and $\theta_0$ are preset initial values of this radius-vector and the angle, and the other notations are auxiliary variables and expressions present in formulas.

The equation for the main reflector 1 will be:

$$z(\theta) = \frac{1}{2}\frac{S[2r(\theta) - S] + x(\theta)[x(\theta) - 2r\sin\theta]}{S - r(\theta)(1-\cos\theta)}. \quad (2)$$

The expressions (1) and (2) are known from the article [Bodulinsky V. K., Kinber B. Ye., Romanova V. I. "Generatrices of Dual-reflector Antennas", Radiotechnika I Electronika, 1985, No. 10, p. 1914-1918].

For a particular case of converting a spherical wave to a plane wave for the law of reflection:

$$x(\theta) = htg\frac{\theta}{2}, \quad (3)$$

where h is the parameter characterizing a size of the main reflector vertical aperture, the shape of the sub-reflector 3 will be hyperbolic or elliptic and will be characterized by a combination of the above parameters:

$$ex = \frac{h + S - 2r_0}{h - S - 2r_0} - \text{hyperbole or ellipse eccentricity.}$$

For example, if ex>1, then a sub-reflector will be hyperbolic, and if ex<1 it will be elliptic. A case where ex>1 corresponds to a Cassegrain system, and at ex<1 corresponds to a Gregory system. The main reflector 1 will always be parabolic.

If the law of reflection x(θ) differs from (3), then the shape of generatrices of a dual-reflector antenna system, which is obtained through the use of the formulas (1)-(2), will differ from the above-indicated, but in such a case the main reflector 1 will not be parabolic, and the sub-reflector 3 will be neither hyperbolic, nor elliptic. It will be understood by those skilled in the art that the law x(θ) is determined from the required characteristics of an antenna directional pattern (e.g., maximum gain factor, minimum level of side lobes, a required shape of an antenna directional pattern etc., or an optimal combination of several parameters).

Figure 6:
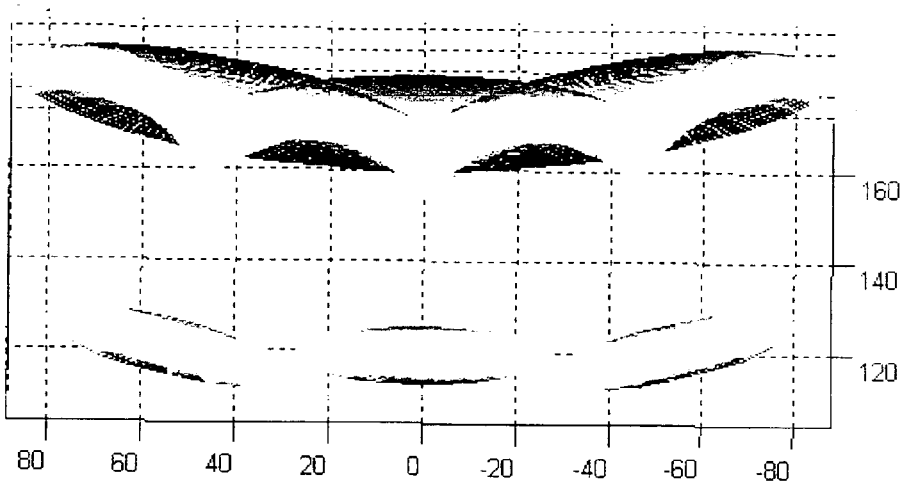
FIG. 6 schematically shows a chart of relative position for feed horns and sub-reflectors.

Several pairs of "feed 2-sub-reflector 3" may be arranged in an antenna as follows. First, a shift for a pair of "feed 2-sub-reflector 3" orthogonally to the axis of revolution should be calculated for a given value of directional pattern (DP) shift with respect to the axis of revolution of the main reflector 1, and, if necessary, geometric parameters of the sub-reflector 3 and spatial positions of the feed 2 and the sub-reflector 3 are adjusted for the purpose of obtaining maximum aperture efficiency (AE) values (FIG. 6). Then, pairs of "feed 2-sub-reflector 3" should be simultaneously arranged in the aperture of the main reflector 1. Herewith, spatial overlapping of the feeds 2 and the sub-reflectors 3 may appear under given technical conditions. In order to implement a calculated antenna system in reality it would be necessary to truncate the surfaces of the sub-reflectors 3 and those of the feeds 2 (horns). It means that only those fragments of overlapping surfaces of the two adjoining sub-reflectors 3 should be selected and included in a real structure that enables the antenna parameters to maintain partial DPs to the fullest extent. In such a case it is of no importance whether sub-reflectors 3 are physically combined into a single body (FIG. 1, 2) or separated (FIG. 3), since the surfaces are mated by truncating (FIG. 1-3, 6, 7) lateral parts of sub-reflectors 3 (and/or feed horns 2).

Lateral parts of sub-reflectors 3 may be truncated from various preconditions and in different ways. As the initial preconditions, one can select, e.g., maximum AE for partial DPs or equal AE for partial DPs. For the purpose of performing these tasks while synthesizing the surfaces of sub-reflectors 3, trial plane cuts of adjoining surfaces of sub-reflectors 3 are made, and specified characteristics of an antenna are calculated. It will be understood by those skilled in the art that adjoining surfaces of sub-reflectors 3 should not necessarily contact each other, but may have a small gap between sections, which would not influence antenna operation (FIG. 3).

If sub-reflectors 3 are cut by plane (FIG. 7), a combined surface of sub-reflectors 3 generally has jumping irregularities which may have a negative bearing on characteristics of a field reflected from sub-reflectors 3. In order to eliminate this effect, a sub-reflector 3 may be truncated with the aim of achieving a maximum smoothness of the combined surface of sub-reflectors 3. In such a case, identical sub-reflectors 3 should be selected, their locations are selected as a result of transfer by revolution around a point located at the Z-axis of the revolution of the main reflector 1, and the edges of the central and lateral sub-reflectors 3 are truncated by planes going through the point of revolution and being bisecting by the angle between the normals of sub-reflectors 3.

Figure 7:
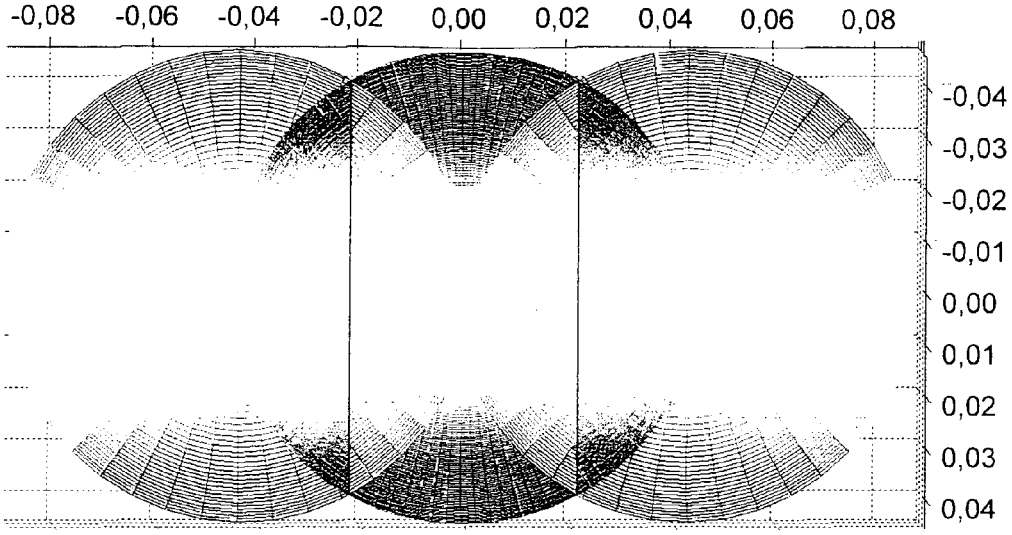
FIG. 7 schematically shows a chart of sub-reflectors truncating.
Figure 8:
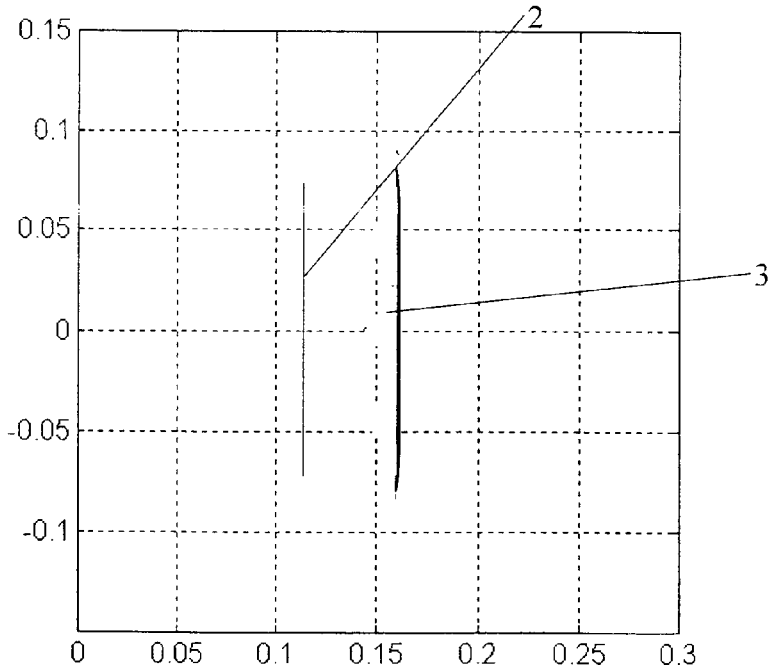
FIG. 8 shows a chart of sub-reflectors truncating, corresponding to FIG. 1.
Figure 9:
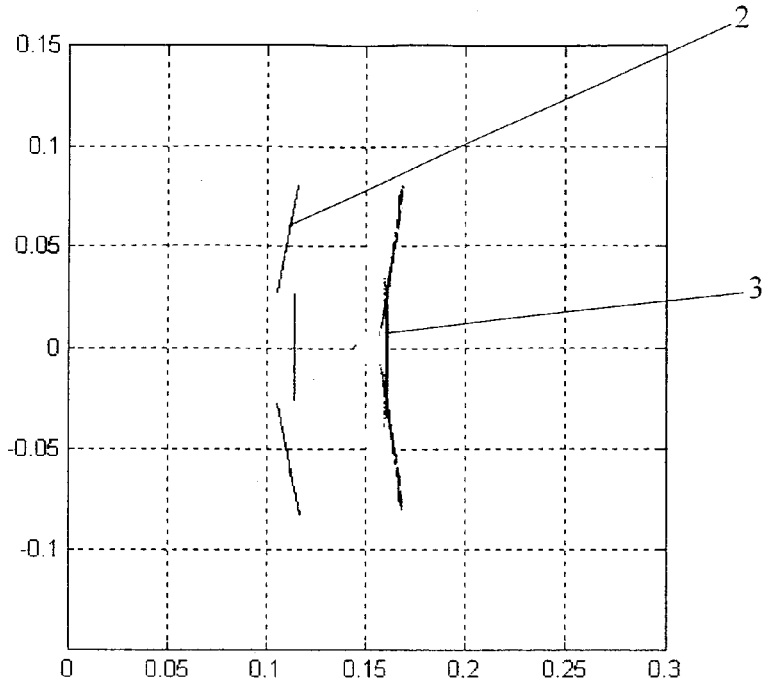
FIG. 9 shows a chart of sub-reflectors truncating, corresponding to FIG. 2.
Figure 10:
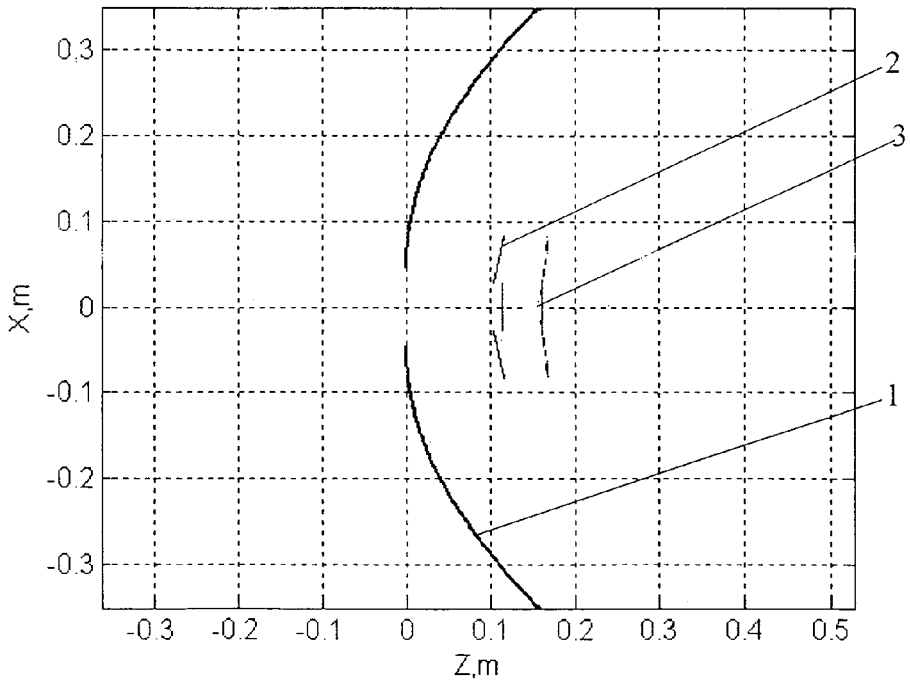
FIG. 10 shows an antenna structure for FIGS. 2 and 9, top view.
Figure 11:
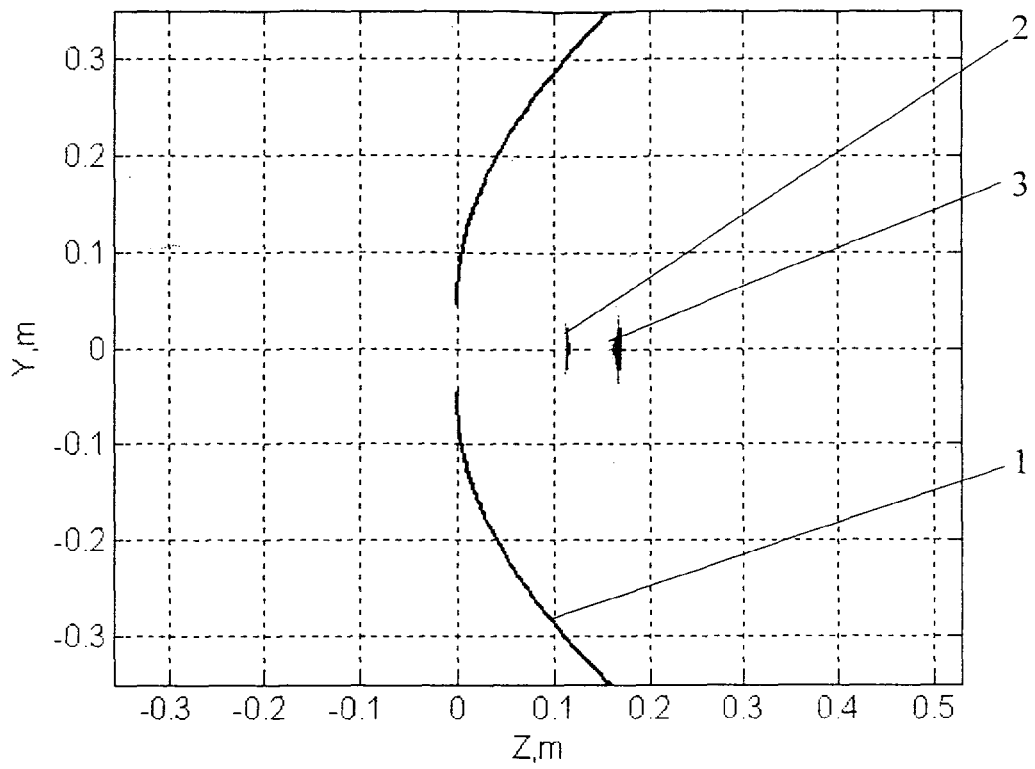
FIG. 11 same as in FIG. 10, side view.

Moreover, it will be understood by those skilled in the art that for the purpose of truncating lateral parts of sub-reflectors 3 curvilinear surfaces (cone, cylinder, surface of arbitrary shape), which are selected on the basis of the above preconditions, may be also used apart from planes (FIG. 7).

The positions of the pairs of "feed 2-sub-reflector 3" (FIG. 1, 8) for a preset tilting of the partial DP main lobes (e.g., ±9° from the central position) was found by moving the pairs of "feed 2-sub-reflector 3" orthogonally to the Z-axis. It is impossible to arrange standard horns near each other in this arrangement; their external walls should be ground off. The diameter of the horn's inner apertures remains unchanged.

Horns may be also truncated by various methods. Truncation may be made on the horn's external wall, not extending into its inner cavity, or it may be made on the horn's inner cavity also. In the latter case horns are combined, and a combined feed is obtained (FIG. 1, 3).

If the longitudinal axes of feeds 2 and their corresponding sub-reflectors 3 are tilted to the longitudinal axis of the main reflector, then horns need not to be truncated (FIG. 2, 9). The position of the pairs of "feed 2-sub-reflector 3" for a given tilting angle of the partial DP main lobes (e.g., ±9° from the central position) was found by moving the pairs of "feed 2-sub-reflector 3" orthogonally to the Z-axis and their subsequent turning. In this arrangement it is possible to dispose standard horns near each other so their external walls need not to be ground off. A standard horn feed having a DP thickness equal to $2\Delta\theta=65°$ at the level of ±10 dB is used as the feed (here θ is a half-width of the DP feed).

In this case gain factors of a multibeam antenna for partial DPs are increased as compared to those for the arrangement variant shown in FIG. 1, 8.

Geometric parameters of the main reflector 1 and the sub-reflectors 3 as well as values of the initial and additional shifts and turn are determined from preset gain values, additional beam tilting angles and parameters of the feed 2.

For a preset deviation of the partial DP main lobes (±9° from the central position) the pairs of "feed 2-sub-reflector 3" (FIG. 2) were moved orthogonally to the Z-axis and then turned. The standard horns of the feeds 2 are arranged near each other.

In the result, the antenna has been obtained (shown in FIG. 2, 10, 11), wherein the longitudinal axes of the feeds 2 are tilted to the longitudinal axis of the main reflector at an angle α that is greater than a tilting angle β of the longitudinal axes of their corresponding sub-reflectors 3 (FIG. 2), the adjoining surfaces of the sub-reflectors 3 are truncated by bisecting planes—mainly by planes tilted about the longitudinal axis of the main reflector 1 at an angle γ that is half of a tilting angle β of the sub-reflector 3, the ratio I=d/D between the maximum diameter d of the sub-reflector 3 and the diameter D of the main reflector 1 being made within $0.1<I<0.2$ (similarly to the arrangement shown in FIG. 1).

Figure 12:
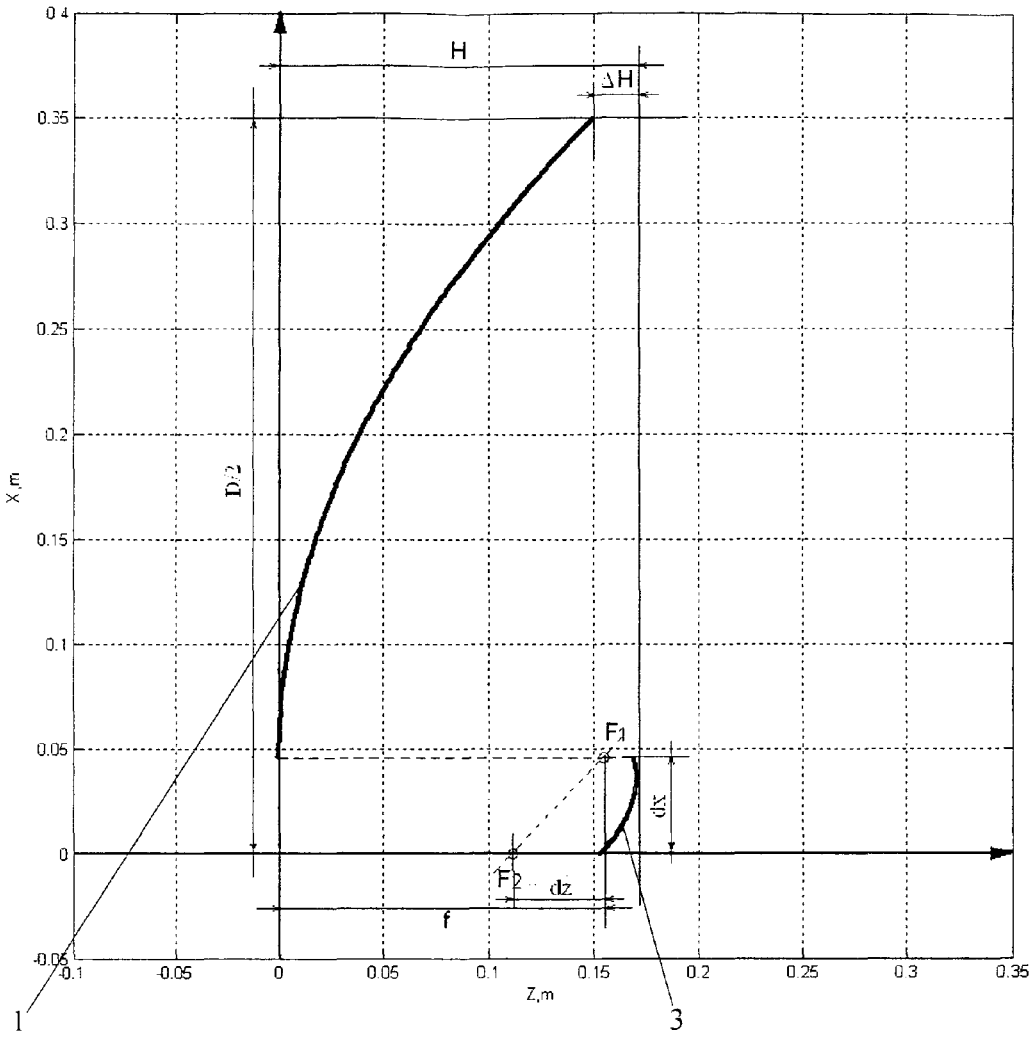
FIG. 12 schematically shows construction of generatrices for the main reflector and the sub-reflector of a multibeam antenna system.

The generatrix of the main reflector 1 (FIG. 12) is a parabola fragment with the center in the point F1, which is limited at the top by the dimension x=D/2, and at the bottom by the dimension x=dx. The sub-reflector 3 is an elliptic surface fragment with the focuses in the points F1 and F2 and the eccentricity equal to 0.7228. The elliptic surface is limited at the top by the dimension x=dx, and at the bottom by the dimension x=0.

D=700 mm; f=146 mm; dz=43.33 mm; dx=45.65 mm; ex=0.7228.

Representative dimension values are shown in Table 1.

TABLE 1

| H | ΔH | D/2 | F1(x) | F1(z) | F2(x) | F2(z) | dx | dz | ex | f |
|---|---|---|---|---|---|---|---|---|---|---|
| 170.3 | 11.3 | 350 | 45.65 | 146.0 | 0.0 | 102.67 | 45.65 | 43.33 | 0.7228 | 146.0 |

Axially symmetrical surfaces of the main reflector 1 and the sub-reflectors 3 are formed by revolving the said generatrices around the Z-axis.

Figure 13:
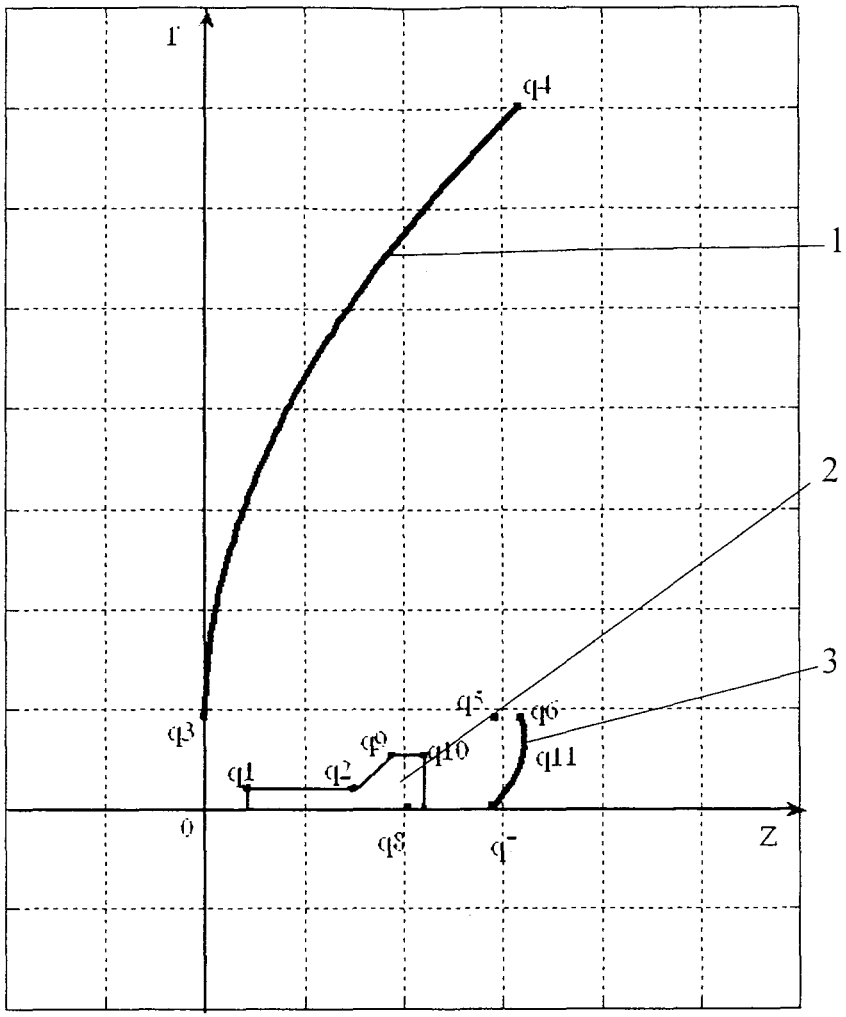
FIG. 13 shows coordinates of characteristic points for a central pair of "horn-sub-reflector"

Representative coordinates of the points for the pair of "feed 2-sub-reflector 3" (FIG. 13) for a case where the feed 2 is made in the form of a standard horn are shown in Table 2.

TABLE 2

| | q1 | q2 | q3 | q4 | q5 | q6 | q7 | q8 | q9 | q10 | q11 |
|---|---|---|---|---|---|---|---|---|---|---|---|
| z, mm | 24.67 | 78.67 | 0 | 158.98 | 146.00 | 159.88 | 144.05 | 102.67 | 98.17 | 114.67 | 161.40 |
| r, mm | 9.65 | 9.65 | 45.65 | 350.36 | 45.65 | 45.65 | 0 | 0 | 27.00 | 27.00 | 35.88 |

Figure 14:
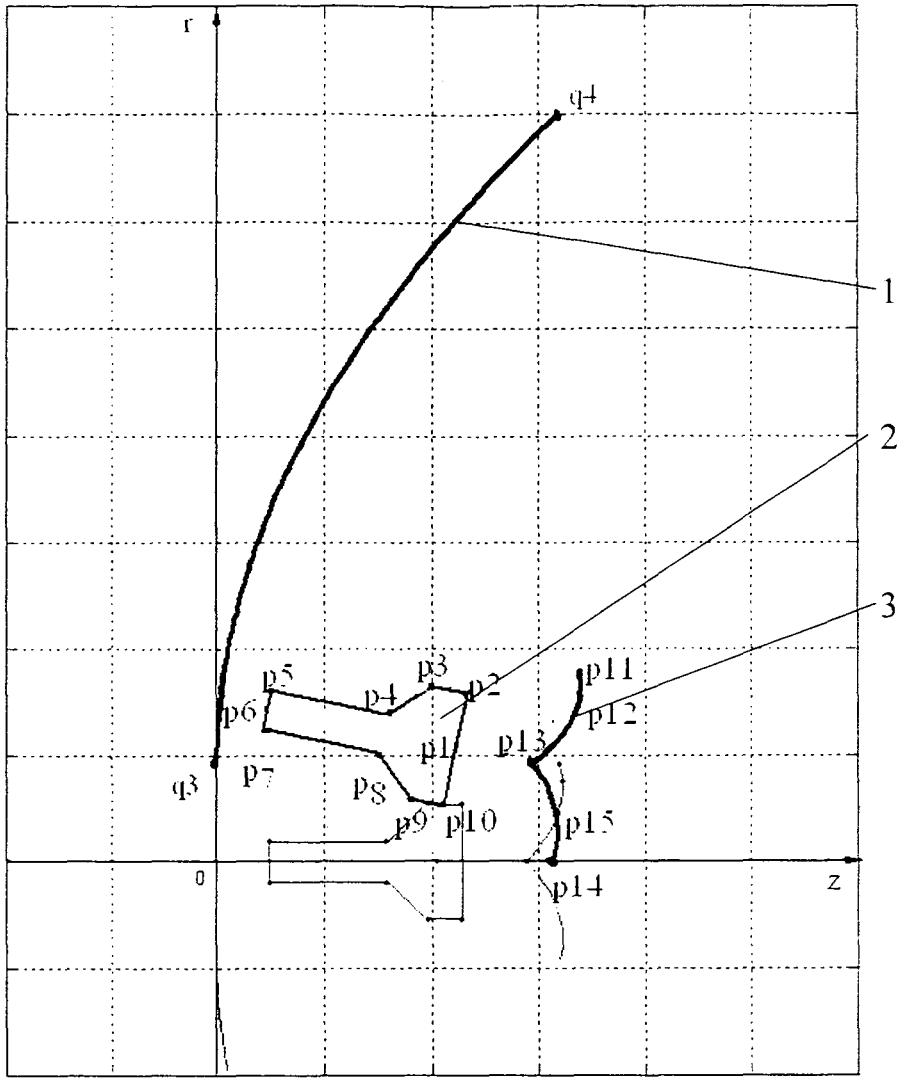
FIG. 14 shows coordinates of characteristic points for a lateral pair of "horn-sub-reflector"

The coordinates of representative points for the lateral pair of "feed 2-sub-reflector 3" (FIG. 14) are shown in Table 3.

TABLE 3

| | p1 | p2 | p3 | p4 | p5 | p6 | p7 | p8 |
|---|---|---|---|---|---|---|---|---|
| z, mm | 110.36 | 116.89 | 100.89 | 77.76 | 25.37 | 23.03 | 20.70 | 73.09 |
| r, mm | 55.41 | 81.61 | 85.61 | 73.49 | 86.57 | 77.21 | 67.84 | 54.77 |

| | p9 | p10 | p11 | p12 | p13 | p14 | p15 |
|---|---|---|---|---|---|---|---|
| z, mm | 87.81 | 103.82 | 169.87 | 170.29 | 147.14 | 155.7 | 158.4 |
| r, mm | 33.21 | 29.22 | 88.96 | 83.78 | 46.33 | −1.22 | 21.33 |

Coordinates for the horn (radius=27.00 mm) and the sub-reflector 3 (radius R=45.65 mm) have been selected in a simplified manner and are shown in Table 4.

TABLE 4

| Coordinates for the horn aperture center | Horn axis tilt angle (from Z-axis) | Aperture edge coordinates | Reflector axis tilt angle (from Z-axis) |
|---|---|---|---|
| Z = 110.36 mm<br>r = 55.41 mm | 0.24446 rad.<br>(14.02°) | Z = 169.87 mm<br>r = 88.96 mm | 0.1559 rad.<br>(8.93°) |

The sub-reflectors 3 are truncated in the point p15 (FIG. 14) by bisecting planes, i.e., planes that are tilted toward the axis at an angle half of the tilt angle of the sub-reflector 3 (namely, at an angle of 4.47°=8.93°/2).

Figure 15:
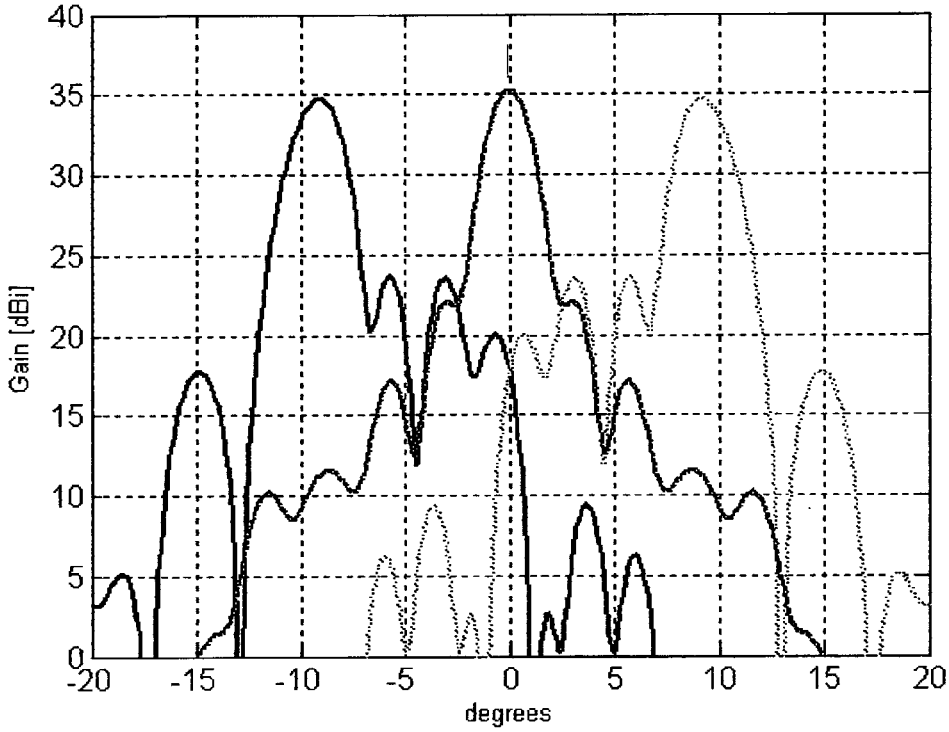
FIG. 15 shows partial directional patterns for the multibeam antenna shown in FIG. 2, 10, 11.

The partial DPs for such an antenna are located to the right and to the left of the central partial DP at 9° (FIG. 15). Gain for a multibeam antenna (FIG. 2) for partial DPs is increased compared to those used for the arrangement variant shown in FIG. 1.

In addition to the above description of antenna, it is understood that the invention regarding one feed and at least two sub-reflectors in a main reflector can be included in the present invention.

It would be understood by those skilled in the art that the described embodiment does not cover all possible structural implementations of the inventive solution which essence is characterized in the independent claim of the appended Claims.

INDUSTRIAL APPLICABILITY

The inventive compact multibeam reflector antenna is industrially applicable, most beneficially as a satellite television antenna.

The invention claimed is:

1. An antenna, comprising a main reflector, at least two feeds and at least two sub-reflectors, each of the latter being intended for re-reflecting a wave from its corresponding feed to said main reflector and converting a feed wave front to a plane wave front reflected from said main reflector, characterized in that each sub-reflector is provided with such a form of its external surface which ensures reflection of a feed directional pattern central beam to the edge of said main reflector and reflection of a lateral beam to a central area of said main reflector, wherein the adjoining surfaces of said sub-reflectors are truncated to be mated.

2. An antenna according to claim 1, characterized in that a common cover is introduced, which is installed in the circumferential plane of said main reflector, and the sub-reflectors are fixed to said cover.

3. An antenna according to claim 1, characterized in that said feeds are made in the form of horns.

4. An antenna according to claim 3, characterized in that adjoining walls of said horns are mated.

5. An antenna according to claim 1, characterized in that the longitudinal axes of said feeds and their corresponding sub-reflectors are tilted in relation to the longitudinal axis of said main reflector.

6. An antenna according to claim 5, characterized in that the longitudinal axes of said feeds are tilted toward the longitudinal axis of said main reflector at a greater angle than the longitudinal axes of their respective sub-reflectors.

7. An antenna according to claim 5, characterized in that adjoining surfaces of said sub-reflectors are truncated by bisecting planes, mainly planes tilted toward the longitudinal axis of said main reflector at an angle that half of the sub-reflector tilt angle.

8. An antenna according to claim 1, characterized in that said sub-reflector adjoining surfaces have a gap.

9. An antenna according to claim 1, characterized in that said main reflector is made as a body of revolution.

10. An antenna according to claim 9, characterized in that the ratio I=d/D between the maximum diameter d of said sub-reflector to diameter D of opening of said main reflector is made within the limits $0.1<I<0.2$.

11. An antenna according to claim 9, characterized in that the generatrix shape for said main reflector is parabolic.

12. An antenna according to claim 1, characterized in that said sub-reflector is made as a body of revolution.

13. An antenna according to claim 12, characterized in that the generatrix shape for said sub-reflector is elliptic.

14. An antenna according to claim 13, characterized in that the generatrix shape for said sub-reflector is hyperbolic.

15. An antenna according to claim 12, characterized in that the ratio I=d/D between the maximum diameter d of said sub-reflector to diameter D of opening of said main reflector is made within the limits $0.1<I<0.2$.

16. An antenna, comprising a main reflector, a feed and at least two sub-reflectors, each of the latter being intended for re-reflecting a wave from said feed to said main reflector and converting a feed wave front to a plane wave front reflected from said main reflector, characterized in that each sub-reflector is provided with such a form of its external surface which ensures reflection of a feed directional pattern central beam to the edge of said main reflector and reflection of a lateral beam to a central area of said main reflector, wherein the adjoining surfaces of said sub-reflectors are truncated to be mated.

* * * * *